US011457678B2

(12) United States Patent
Hironaka et al.

(10) Patent No.: US 11,457,678 B2
(45) Date of Patent: Oct. 4, 2022

(54) CONVERTIBLE MULTI-USE GARMENT AND CUSHION WITH STOWABLE STORAGE POUCH

(71) Applicant: Wind & Stitch LLC, Highland, UT (US)

(72) Inventors: Robin S. Hironaka, Alpine, UT (US); Nathaniel P. Story, Cedar Hills, UT (US); Stephen P. Story, Highland, UT (US)

(73) Assignee: WIND & STITCH LLC, Highland, UT (US)

( * ) Notice: Subject to any disclaimer, the term of this patent is extended or adjusted under 35 U.S.C. 154(b) by 0 days.

(21) Appl. No.: 16/844,775

(22) Filed: Apr. 9, 2020

(65) Prior Publication Data

US 2021/0315299 A1 Oct. 14, 2021

(51) Int. Cl.

| | |
|---|---|
| ***A41D 15/04*** | (2006.01) |
| ***A41D 27/20*** | (2006.01) |
| ***A41D 27/24*** | (2006.01) |
| ***A41D 3/00*** | (2006.01) |
| ***A41D 31/06*** | (2019.01) |
| ***A41D 31/10*** | (2019.01) |
| *A47C 27/00* | (2006.01) |
| *A47G 9/10* | (2006.01) |

(52) U.S. Cl.

CPC ..... *A41D 15/04* (2013.01); *A41D 3/00* (2013.01); *A41D 27/202* (2013.01); *A41D 27/24* (2013.01); *A41D 31/065* (2019.02); *A41D 31/10* (2019.02); *A41D 2200/20* (2013.01); *A41D 2300/322* (2013.01); *A41D 2300/324* (2013.01); *A47C 27/00* (2013.01); *A47G 9/1045* (2013.01)

(58) Field of Classification Search

CPC ..... A41D 15/04; A41D 15/00; A41D 3/08; A41D 2200/20; A45F 4/14

USPC ..... 2/89

See application file for complete search history.

(56) References Cited

U.S. PATENT DOCUMENTS

| | | | | |
|---|---|---|---|---|
| 2,109,951 A | | 2/1937 | Truesdell et al. | |
| 2,380,909 A | * | 7/1945 | Jackson | A41D 15/04 2/84 |
| 2,462,269 A | | 11/1947 | Krempel | |
| 2,839,757 A | * | 6/1958 | Gianola | A42B 1/045 2/205 |
| 2,967,306 A | * | 1/1961 | Fabanich | A41D 3/08 2/94 |

(Continued)

*Primary Examiner* — Alissa L Hoey

(74) *Attorney, Agent, or Firm* — Bretton L. Crockett; TechLaw Ventures, PLLC

(57) ABSTRACT

Apparatus, systems and methods related to convertible garments for multiple uses. In one illustrative embodiment, one exemplary convertible garment may include a multilayered textile body having a central opening, which can be arranged in a first conformation to serve as an insulated jacket or poncho that features a hood disposed at the central opening, and, may include hand-warming and security pockets and a yoke with a closeable recess. Such a convertible garment can be arranged in a second conformation to serve as an insulated ground cloth and reversed to serve as a protective cover or blanket. The garment may feature an attached storage pouch that is stowed in the yoke recess in the first and second conformations. In a third conformation, the garment may be folded and stowed in the storage pouch to serve as a vented cushion.

18 Claims, 7 Drawing Sheets

(56) References Cited

U.S. PATENT DOCUMENTS 3,228,034 A * 1/1966 Grove ..... A41D 15/04 5/413 R
3,522,612 A 8/1970 Palmer
3,835,471 A 9/1974 Lankford
4,060,852 A 12/1977 Meeks
4,078,264 A * 3/1978 DeGennaro ..... A41D 3/08 2/88
4,145,762 A * 3/1979 Wallach ..... A41D 7/005 2/67
4,227,264 A * 10/1980 Spector ..... A41D 15/00 2/84
4,272,852 A * 6/1981 Bell ..... A41D 3/00 2/94
4,301,547 A 11/1981 Bloise
4,315,334 A * 2/1982 Pearsall ..... A41D 3/02 2/85
4,404,687 A * 9/1983 Hager ..... A41D 3/005 2/94
4,502,154 A * 3/1985 Itoi ..... A41D 3/00 2/108
4,689,831 A * 9/1987 Greenberger ..... A45F 4/12 2/93
5,165,111 A * 11/1992 Lieberman ..... A41D 15/04 2/108
5,414,881 A 5/1995 Terrazas
5,452,476 A * 9/1995 Jenks ..... A41D 3/00 2/108
5,787,504 A * 8/1998 Wu ..... A41D 15/04 2/93
5,850,634 A * 12/1998 Toombs ..... A41D 15/04 2/93
5,860,164 A * 1/1999 Johnson ..... A41D 15/04 2/94
5,884,331 A 3/1999 Barajas
5,987,644 A * 11/1999 Mengato ..... A41D 27/202 2/69
D430,721 S * 9/2000 Beauchan ..... D2/823
6,134,712 A * 10/2000 Spector ..... A41D 15/04 2/94
6,275,993 B1 8/2001 McCarley
6,353,933 B1 3/2002 Love
6,564,388 B1 * 5/2003 Poston ..... A41D 15/04 2/84
6,665,878 B1 * 12/2003 Way ..... A41D 3/02 2/84
6,708,343 B1 * 3/2004 Ceron ..... A41D 3/08 2/84
6,760,921 B1 * 7/2004 Simmons ..... A41D 3/08 2/84
6,851,127 B1 * 2/2005 Khan ..... A41D 13/00 2/84
7,296,302 B2 * 11/2007 DeLorenzo ..... A41D 3/005 2/202
D600,884 S 9/2009 Patton
7,788,736 B2 * 9/2010 Gollin ..... A45F 4/12 2/94
8,161,572 B1 * 4/2012 Rorke ..... A45D 44/08 2/50
D677,859 S 3/2013 Andes
9,521,873 B1 * 12/2016 Mignone ..... A41D 13/1161
9,867,453 B1 * 1/2018 Diaz ..... A41D 15/04
10,080,391 B2 * 9/2018 Rundle ..... A41D 3/08
10,455,925 B1 * 10/2019 Valdes ..... A45F 3/04
10,477,905 B1 * 11/2019 Sachs ..... A41D 3/005
D877,461 S * 3/2020 Mieszczak ..... D2/860
10,588,362 B1 * 3/2020 Alexei ..... A45C 9/00
10,791,774 B2 * 10/2020 Plant ..... A41D 27/207
10,874,199 B2 * 12/2020 James ..... A45F 4/12
10,973,309 B2 * 4/2021 Thomas ..... A45F 3/04
2003/0033658 A1 * 2/2003 Hinnant ..... A41D 15/04 2/93
2003/0205593 A1 * 11/2003 Lavelle ..... A41D 3/08 224/153
2004/0073985 A1 * 4/2004 Riccelli ..... A41D 3/08 2/69
2004/0187186 A1 * 9/2004 Boezi ..... A41D 15/005 2/84
2005/0056669 A1 * 3/2005 Lavelle ..... A45F 4/12 224/153
2005/0160514 A1 * 7/2005 Flaniken ..... A41D 3/005 2/84
2005/0246823 A1 * 11/2005 Groom ..... A41D 27/20 2/247
2005/0273904 A1 * 12/2005 Valdes ..... A41D 15/04 2/86
2006/0057918 A1 * 3/2006 Burnett ..... A41D 31/065 442/132
2008/0209612 A1 * 9/2008 Summers ..... A41D 3/08 2/84
2009/0205102 A1 * 8/2009 Anderson ..... A41D 3/00 2/85
2010/0122395 A1 * 5/2010 Wall ..... A41D 15/04 2/84
2010/0282803 A1 * 11/2010 Simmons ..... A45F 3/04 224/576
2011/0119800 A1 * 5/2011 Garrido ..... A41D 27/202 2/2.15
2014/0090147 A1 * 4/2014 Tyler ..... A45F 4/12 2/69
2015/0189924 A1 * 7/2015 Desbrow ..... A41D 3/04 2/87
2015/0374044 A1 * 12/2015 Kim ..... A41D 27/08 2/300
2016/0157535 A1 * 6/2016 Tirro ..... A41D 1/02 2/93
2018/0049499 A1 * 2/2018 Noll ..... A42B 1/0186
2019/0350277 A1 * 11/2019 Mahoney ..... A45F 4/12
2020/0154795 A1 * 5/2020 Valster ..... A41D 3/005
2021/0037898 A1 * 2/2021 Bednar ..... A41D 1/215

* cited by examiner

CONVERTIBLE MULTI-USE GARMENT AND CUSHION WITH STOWABLE STORAGE POUCH

TECHNICAL FIELD

The present disclosure relates to apparatus, systems and methods for convertible garments and cushions.

BACKGROUND

Convertible garments that serve as a seating cushion in a first conformation and a poncho or rain cover in a second conformation are known. Typically, such garments either require a separate pouch that is carried with the garment, or, have an integrated pouch that then remains exposed during use. Additionally, prior designs are often limited in use due to placement or lack of features.

A convertible garment that can serve as poncho in one conformation and as a seating cushion in a second conformation, which does not require a separate pouch or have an exposed pouch during use as a garment would be an improvement in the art. Such a garment that has additional uses would be a further improvement in the art.

SUMMARY

The present disclosure includes apparatus, systems and methods related to convertible garments for multiple uses. In one illustrative embodiment, one exemplary convertible garment may include a multilayered textile body having a central opening, which can be arranged in a first conformation to serve as an insulated jacket or poncho that features a hood disposed at the central opening, and, may include hand-warming and security pockets and a yoke with a closeable recess. Such a convertible garment can be arranged in a second conformation to serve as an insulated ground cloth or reversed to serve as a protective cover or blanket. The garment may feature an attached storage pouch that is stowed in the yoke recess in the first and second conformations. In a third conformation, the garment may be folded and stowed in the storage pouch to serve as a vented cushion.

A garment in accordance with the present invention may be useful for outdoor enthusiasts and other users. For example, the fourth conformation it may be easily transported and used as seating cushion and transformed for use as a jacket or blanket due to inclement weather, or as a protective cover. This may be useful at outdoor events, such as attending games, or for travel. The hood may include a face guard portion and the use of multilayered construction can provide for both an insulated garment and a groundcloth that is both waterproof and soft for contacting a user. It will be appreciated that the placement of the central opening may provide for securement when used as a protective cover in an automobile. The use of a separate, yet attached, pouch can prevent its loss, while keeping a sleek appearance.

DESCRIPTION OF THE DRAWINGS

It will be appreciated by those of ordinary skill in the art that the various drawings are for illustrative purposes only. The nature of the present disclosure, as well as other embodiments of the present invention, may be more clearly understood by reference to the following detailed description, to the appended claims, and to the several drawings.

DETAILED DESCRIPTION

The present disclosure relates to apparatus, systems and methods related to convertible garments for multiple uses. It will be appreciated by those skilled in the art that the embodiments herein described, while illustrating certain embodiments, are not intended to so limit the disclosure or the scope of the invention. Those skilled in the art will also understand that various combinations or modifications of the embodiments presented herein can be made without departing from the scope of this disclosure. All such alternate embodiments are within the scope of the present invention.

Figure 7:
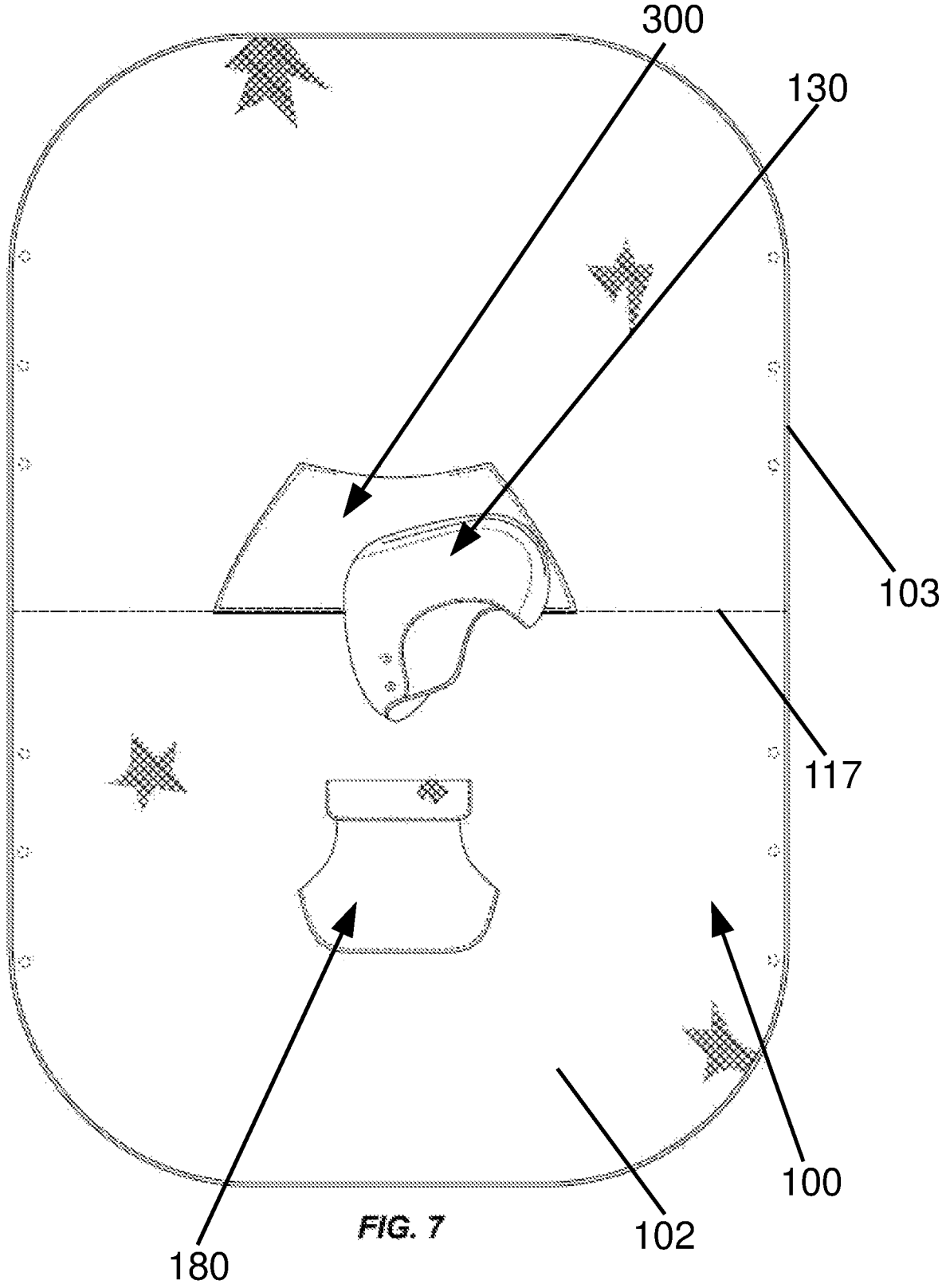
FIG. 7 is a top view of the embodiment of embodiment of FIGS. 1-6 arranged in a second conformation for use as a protective cover or blanket
Figure 8:
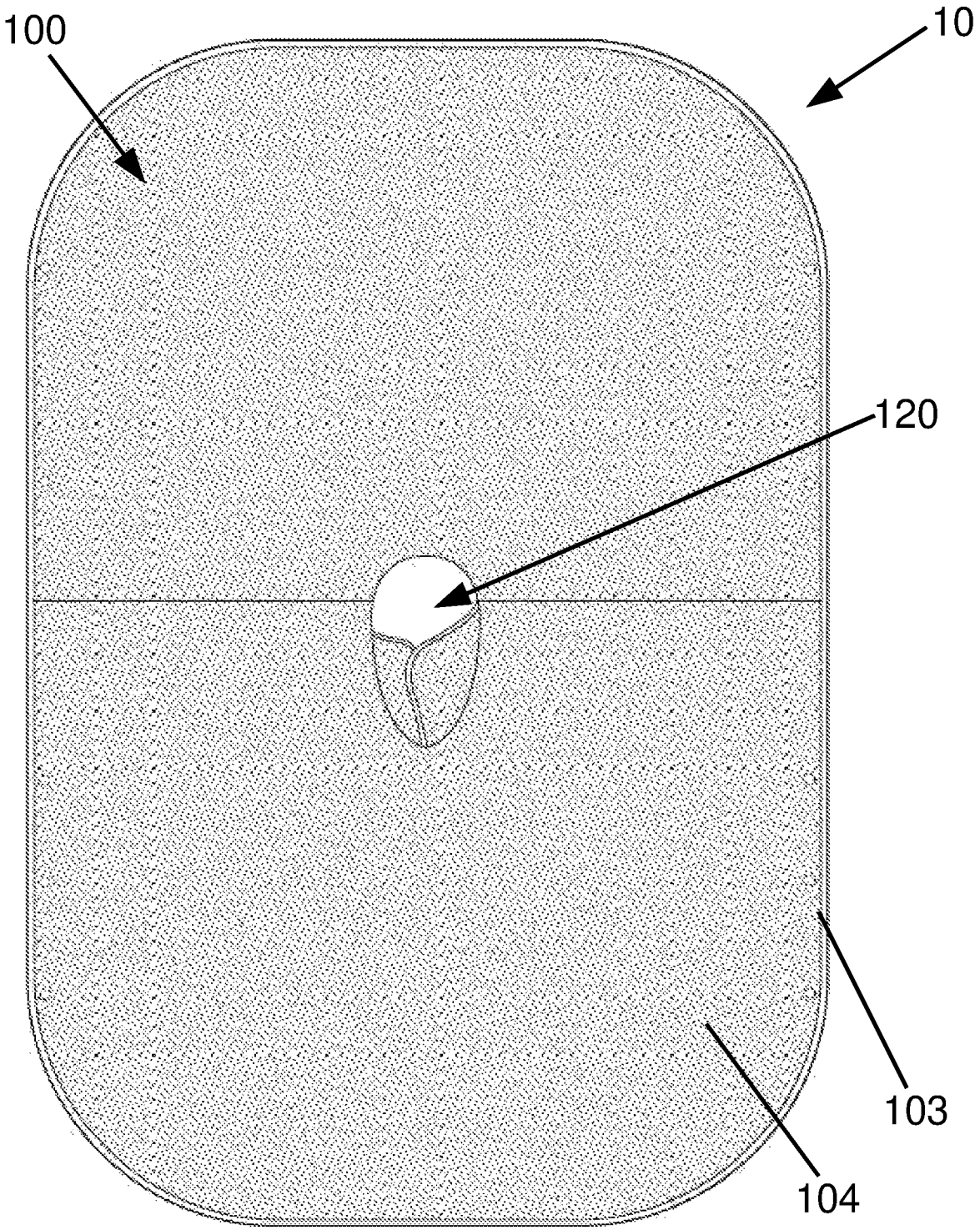
FIG. 8 is a bottom view of the embodiment of FIGS. 1-7 in the second conformation for use as a ground cover.

Referring to FIGS. 1 through 8, a first illustrative embodiment of a convertible garment 10 for multiple uses in accordance with the principles of the present disclosure is depicted. Garment 10 may generally be formed as a multilayered textile body 100. When body 100 is spread out, it may have a generally rectangular shape and may have rounded corners, as best depicted in FIGS. 7 and 8. A first exterior surface 102 of the body 100 may be formed of a water-resistant or waterproof material. Some suitable materials may include rip stop nylon or the like, but it will be appreciated that any textile material having suitable properties may be used. A second exterior surface 104, which is opposite the first surface 102, may be formed of a textile material which has a suitable texture for contacting a user's skin during use, and is thus relatively "soft" in comparison to the first exterior surface 102. Such a material may be insulative in nature, suitable materials may include materials that are used for blankets, such synthetic fleece, flannel or similar materials. It will be appreciated that in some embodiments, the body 100 may be formed from two layers of material, each forming an opposite exterior surface, and that in others additional layers may be present to provide additional cushioning, insulation or other desired properties to the body 100. The various layers may be joined to one another in a suitable fashion, such as by stitching placed to form a rolled edge seam, by using a suitable adhesive or as is otherwise known in the art. It will be appreciated that the edge may be include a piping material, which may be formed from the same material as the first exterior surface 102, or the material of the first exterior surface 102 may be rolled to extend to the periphery of the second exterior surface, provide a sealed edge or a waterproof "rim" 103 (FIG. 5) around the second exterior surface.

A central opening 120 (best depicted in FIG. 8) passes though the body 100 generally at a midpoint thereof and is sized and configured to allow a user to pass their head therethrough for use in at least one conformation.

Turning to FIGS. 1-6, garment 10 is depicted with the multilayered textile body 100 arranged in a first conformation to serve as an insulated jacket or poncho. The body 100 has been folded along a center line CL (FIG. 5), which may be defined by a seam, with the second exterior surface 104 facing itself to form a poncho space PS there between, with the central opening 120 disposed at an upper end thereof along a sloping upper surface 117 corresponding to the shoulders of a wearer with a ridge that may be defined by the center line CL. The outward facing portions of the first exterior surface 102 define a poncho front surface 112 and poncho rear surface 114. The sides of the body 100 may be retained in position by a series of fasteners, such as snaps indicated at 116A, 116B and 116C, that are placed along the sides body. A gap between the uppermost fastener 116A and the upper surface 117 may define a sleeve opening 118 for a user's hand.

A hood assembly 130 may be disposed on the exterior surface 102 around the central opening. The hood assembly 130 may be formed as a pouch defined by sidewalls, which is disposed around the central opening 120, and is sized and configured to cover the head of a user wearing the garment 10 in the poncho conformation. In the depicted embodiment, the sidewalls include a right panel 132 that defines a right side of the hood 130, a left panel 134 that defines a left side of the hood and a central panel that defines a back and top of the hood 130. Each of right panel 132, left panel 134, and central panel 136 are joined to the body 100 of the garment around the central opening 120, and then each of right panel 132 and left panel 134 are joined to central panel 136 along an opposite long side thereof to jointly define a rounded opening 131 for a user's face when wearing the garment 10.

At a front portion of hood assembly 130 a face mask assembly 140 may be disposed. The face mask assembly 140 may be formed from an extension the right panel 132 and/or left panel 134 that is joined to the body 100 at a lower end with an upper corner extending medially and upwards to allow it to be drawn over the face of a user, partially closing the rounded opening 131. In the depicted embodiment, each of the right panel 132 and left panel 134 feature a face mask extension 142 and 144, respectively, that may be drawn over one another to provide coverage of the lower portion of a user's face. The right and left face mark extension members 142 and 144 may be fastened together using fasteners, such as snaps indicated at 146A and 146B to retain in a closed position. When the members are unfastened, the flexible nature of the members allows them to relax and pivot to extend the rounded opening 131 to the body 100. Similarly, when not in use, the face mask assembly 140 may be opened and the hood assembly 130 collapsed on the body 100.

It will be appreciated that the hood assembly 130 may be constructed from multilayered textile members, or as a multilayered textile assembly, similar to body 100 to provide a water and wind resistant outer surface that is insulated and/or comfortable for a user to wear.

As depicted, the garment 10 may include a pocket assembly 180 for providing storage pockets to a user. As depicted, the pocket assembly 180 may be disposed on first surface 102 at a position where it will be accessible on the front surface 112 when garment 10 is placed in the first conformation. In the depicted embodiment, pocket assembly 180 includes a hand pocket member 182, which may be formed as a textile member having upper, lower and two side edges (in relation to the front surface 112), disposed on the first surface 102. The hand pocket member 182 may be joined to the body 100 along the lower side, as by a lower seam 184, which may extend partway up the sides thereof, and along the top surface, as by a similar seam (not pictured). At least an opening portion 186 of each side is not joined to the body 100, to define a hand warming pocket opening 183 between the hand pocket member 182 and the front surface 112, which may be sized and oriented to facilitate insertion of a user's hand therein. It will be appreciated that the hand pocket member 182 may be constructed as a multilayered textile assembly, similar to body 100 to provide a water and wind resistant outer surface and an insulated pocket which is more comfortable for a user.

Pocket assembly 180 may further include a security flap 190, formed as a textile member attached to the body near its top edge, which hangs down over at least a portion of the hand pocket member 182. The lower portion of pocket flap 190 may be secured to the garment, using a suitable fastener, such strips of a hook and loop material placed at the appropriate positions. An opening for a pocket formed as a pouch extending into the body 100 or the hand pocket member 182 may be disposed under the pocket flap 190 (not depicted). The pocket flap 190 may provide security to such pocket by shielding the opening and the opening may be further secured by an additional fastener, such as being closed by a zipper.

Figure 1:
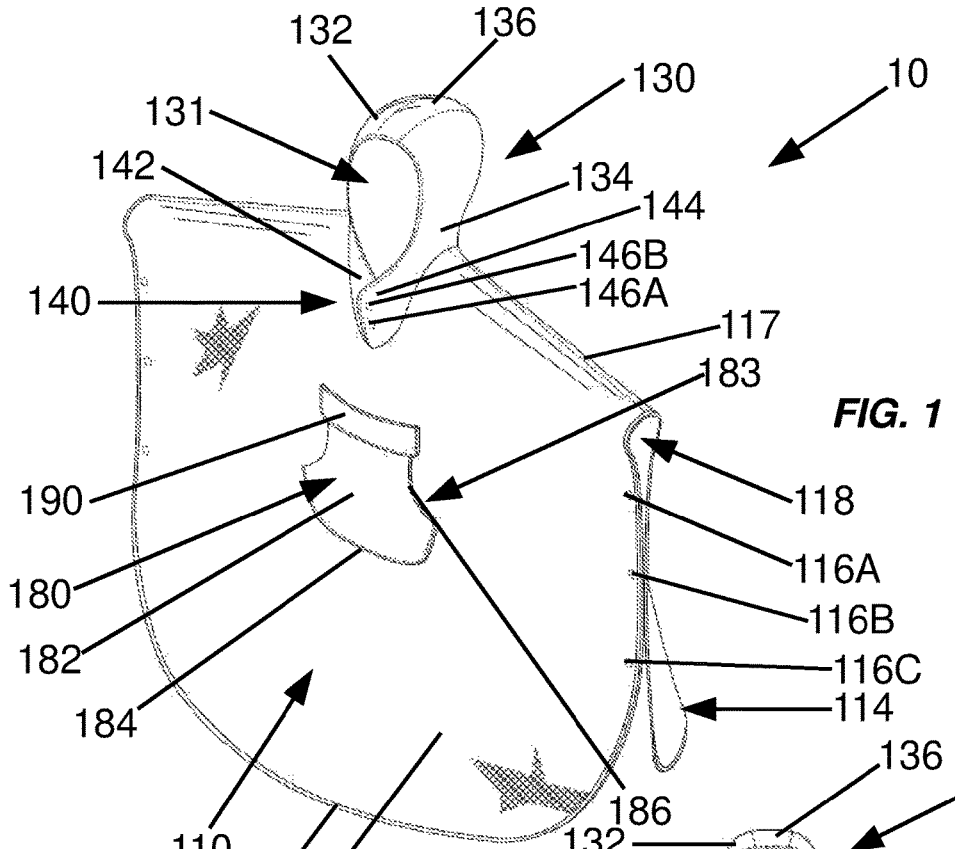
FIGS. 1, 2, 3, 4, 5, 6 are perspective, front, rear, left, right, and top views of one illustrative embodiment of a multi-use garment in accordance with the principles of the present disclosure arranged in a first conformation for use as a poncho or jacket.
Figure 2:
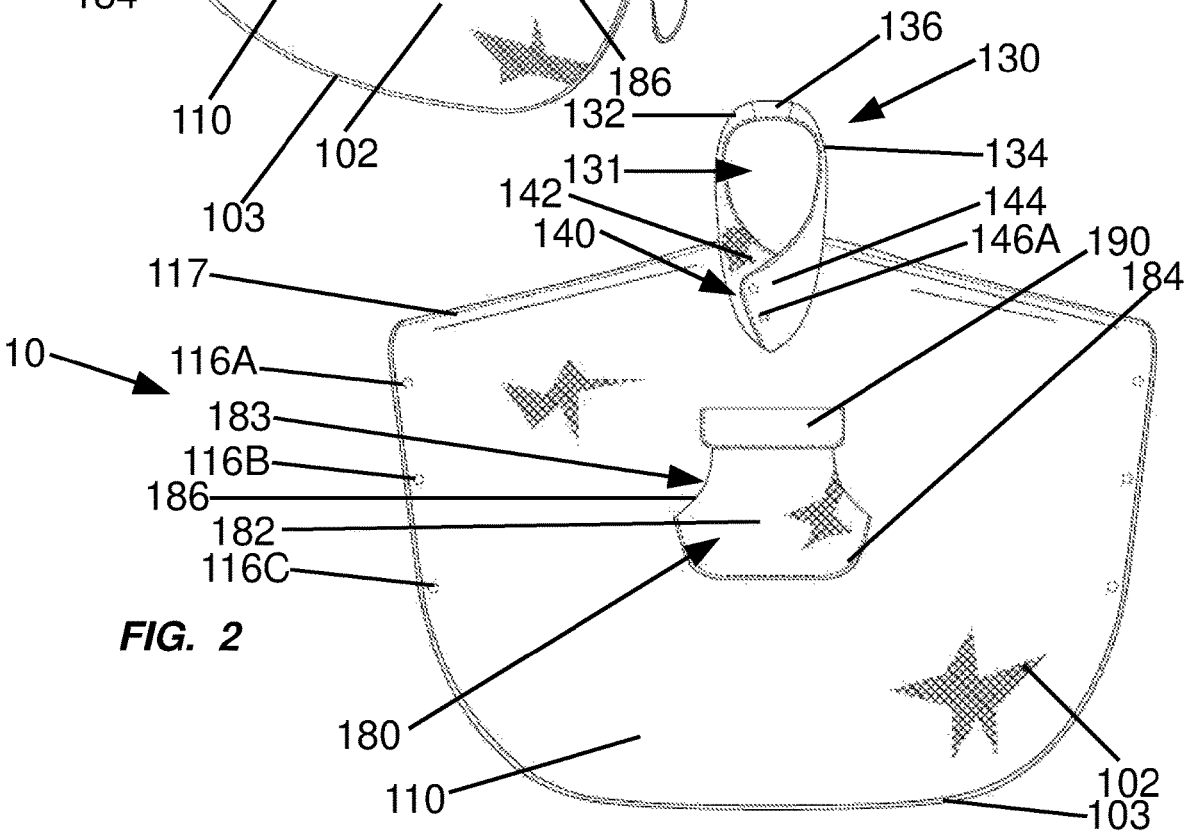
Figure 3:
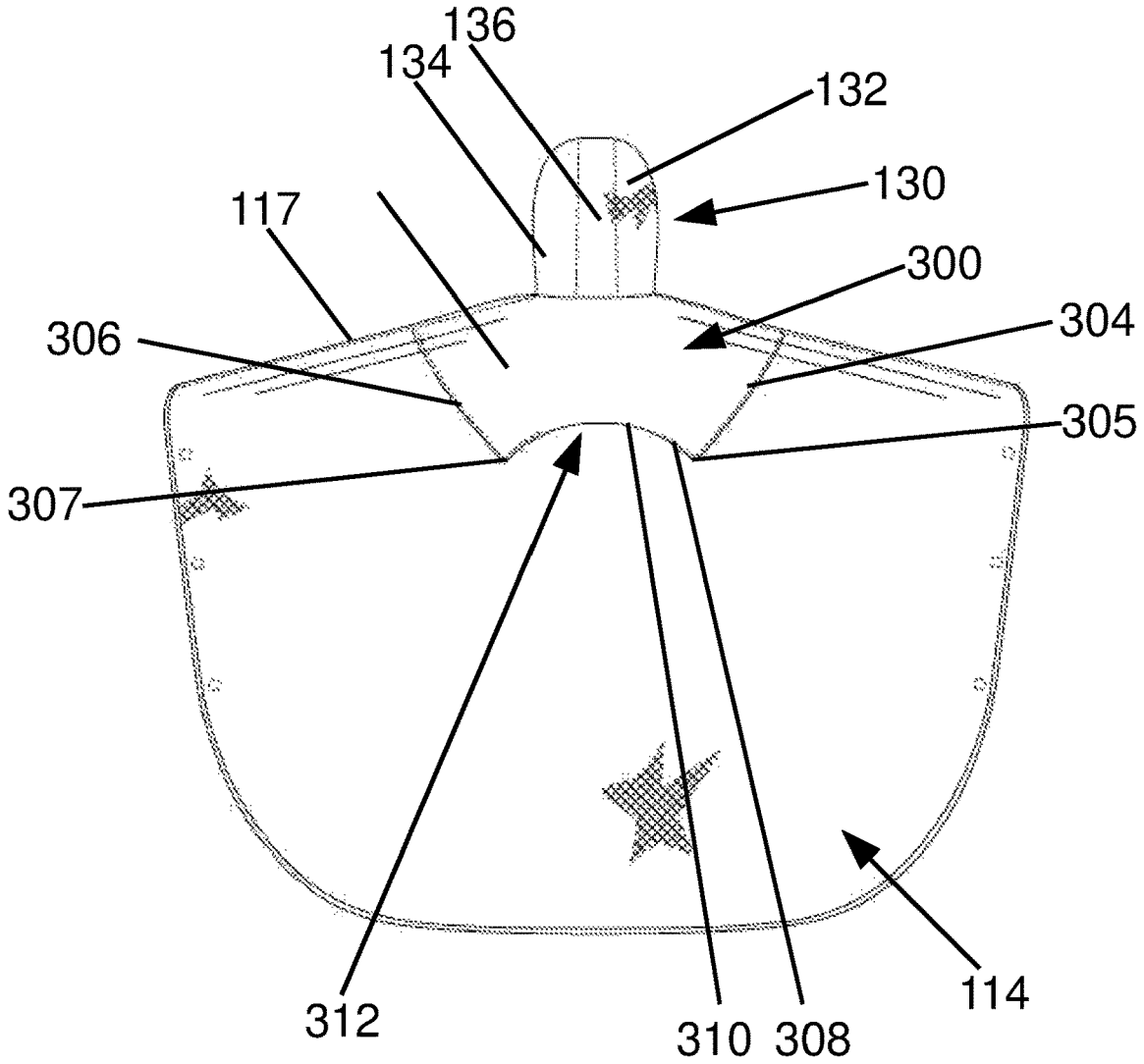
Figure 6:
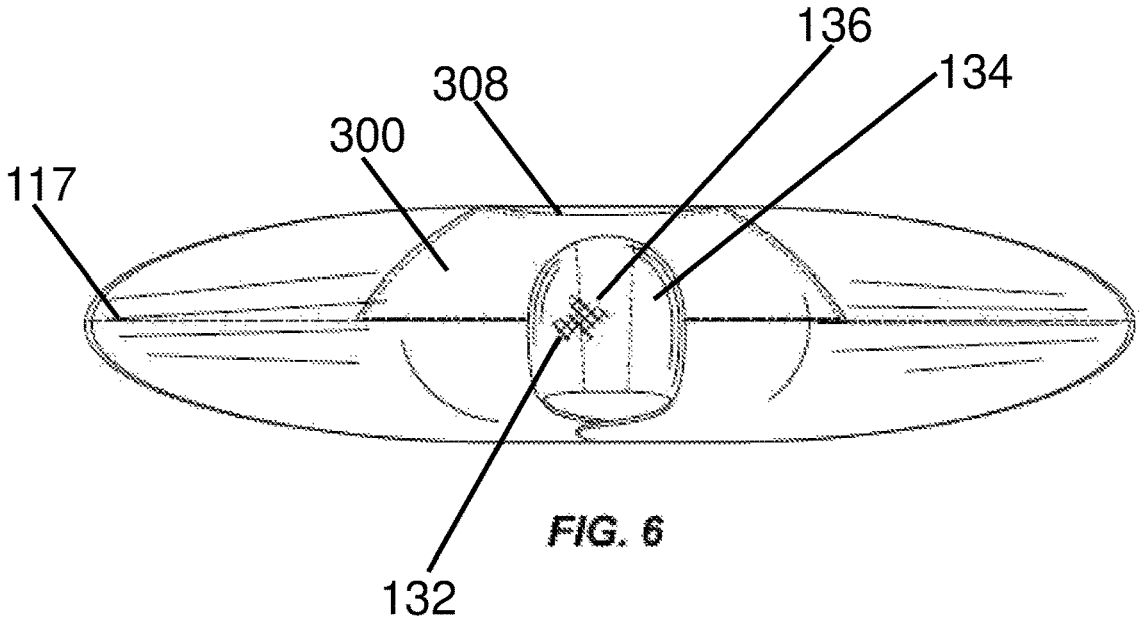
Figure 4:
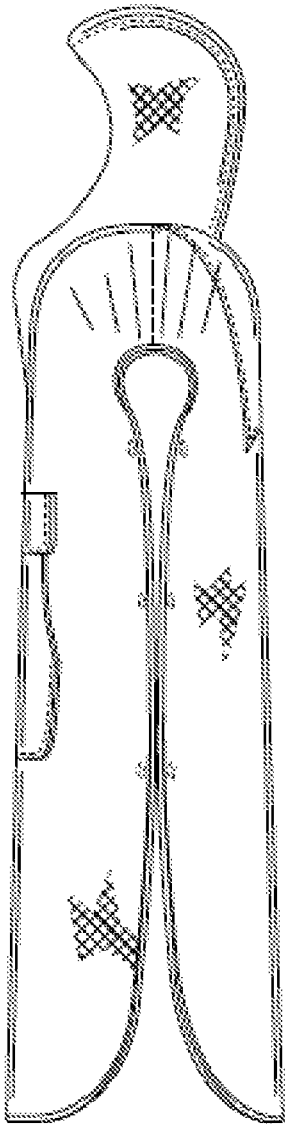
Figure 5:
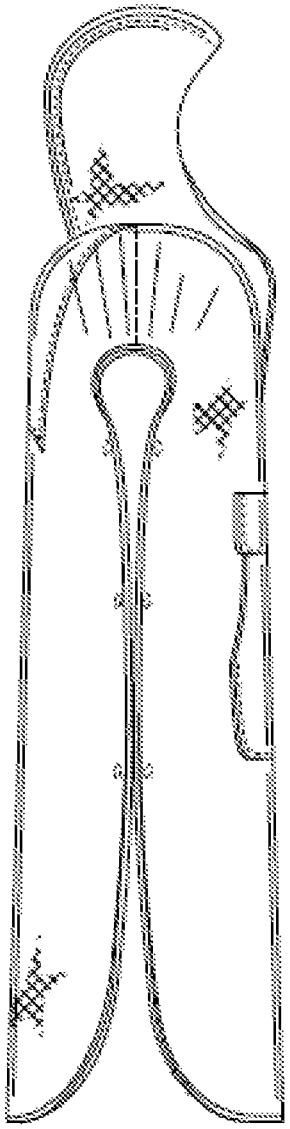

As best depicted in FIG. 3, the garment 10 may include a yoke assembly 300. In the depicted embodiment, yoke assembly 300 includes a yoke member 301, which may be formed as a textile member having an upper edge that is disposed extending across at least a portion of the width of the body 100 along the central seam 117 to opposite right and left upper corners. Opposite right and left sides 304 and 306 extending inwards and downwards from the upper corners to right and left lower corners 305 and 307. Lower side 308 may be formed as concave curve extending upward between the lower corners. The yoke member 301 may be joined to the body 100 along the upper side at seam 117 and along each of right and left sides 304 and 306. From each of the lower corners 305 and 307, the outer portions of lower side 308 may be joined to the body. A central opening portion 310 of the lower side 308 is not joined to the body 100, but defines a yoke opening 312 between the yoke member 301 and the rear surface 114. A yoke recess 320 (FIG. 10) is accessible through the yoke opening. Yoke member 301 may be constructed from the same type of material as first surface 102.

Such a convertible garment can be arranged in a second conformation to serve as an insulated ground cloth and arranged in a third conformation to serve as a protective cover or blanket. The garment may feature an attached storage pouch that is stowed in the yoke recess in the first, second and third conformations. In a fourth conformation, the garment may be folded and stowed in the storage pouch to serve as a vented cushion.

Turning to FIGS. 7 and 8, garment 10 is depicted in a second conformation for use as a protective cover or blanket and in a third conformation for use as a ground cover or protective. From the first conformation, a user may release the fasteners, such as snaps 116A, 116B and 116C, to allow to draw the front 112 and rear surfaces 114 of the first conformation apart and deploy the garment 10 in a generally planar form. As depicted in FIG. 7, when the first surface 102 is deployed outwards (or upwards) facing and the second surface 104 is deployed inwards, the garment 10 may be used as a protective cover or blanket. For example, a user laying under the garment 10 will contact the insulative second side 104, being able to remain warm underneath the garment, with the water and wind resistant outer member 102 providing protection from the outside elements. A user could drape the garment over an item to be protected from the elements thereby, with the item contacting the softer second surface.

As depicted in FIG. 8, when the second surface 104 is deployed outwards (or upwards) facing and the first surface 104 is deployed inwards (or downwards), the garment 10 may be used as a ground cloth style protective cover. For example, by laying the garment to on the ground with the water resistant first side 102 down, the insulative second side 104 faces upwards for use as a picnic blanket, sleeping surface or the like. A user could drape the garment over an item that is damp to help keep surrounding items dry.

It will be appreciated that the central opening 120 allows the garment to be secured in a desired position for use as a protective cover. For example, when transporting pets, such as dogs, the garment 10 may be placed in the second conformation, then draped over the seat of an automobile with the central opening aligned with the seat belt buckle attached or associated with the seat, typically disposed near the lower side or between the seat back and seat cushion. The car seat belt may then be drawn over the garment 10 and the counterpart buckle clip disposed thereon fastened to the seat belt buckle to secure the garment in place. Where pets are wet or muddy, it may be preferred to drape the garment 10 with the water-resistant surface 102 disposed outwards to protect the automobile interior.

Turning to FIGS. 9, 10, 11, and 12 components that allow for the garment 10 to be placed into a fourth conformation for storage or use as a cushion are depicted. A storage bag 400 which is attached to the garment 10 by a connection strap 350 may be formed as a rectangular bag with an open top that is closable by a top flap 402. A zipper 408 may be used to secure the top flap 402 to the body of bag 400 in a closed position. a handle 404 may be disposed on the top 402, which may be formed as strap secured thereto. One or more ports may be formed in the top flap 402, as by grommets 406A or 406B. it will be appreciated that the number of ports may vary and that in addition to grommets, the ports may be formed as openings with surrounding stitching to prevent fraying of the bag material or as is otherwise known in the art. Additionally, it will be appreciated that the placement of the ports may vary and may be in other portions of the storage bag 400.

Figure 9:
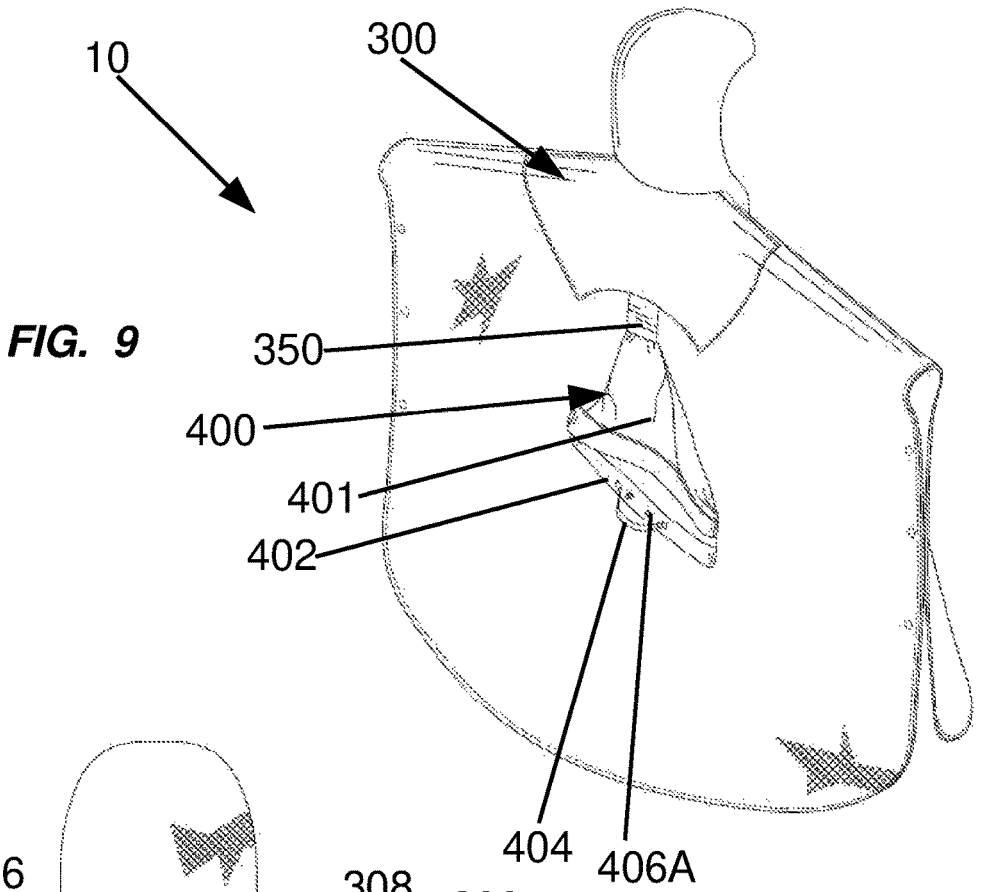
FIGS. 9 and 10 illustrate views of the connection of components that allow for arranging the embodiment of FIGS. 1-8 into a third conformation.
Figure 10:
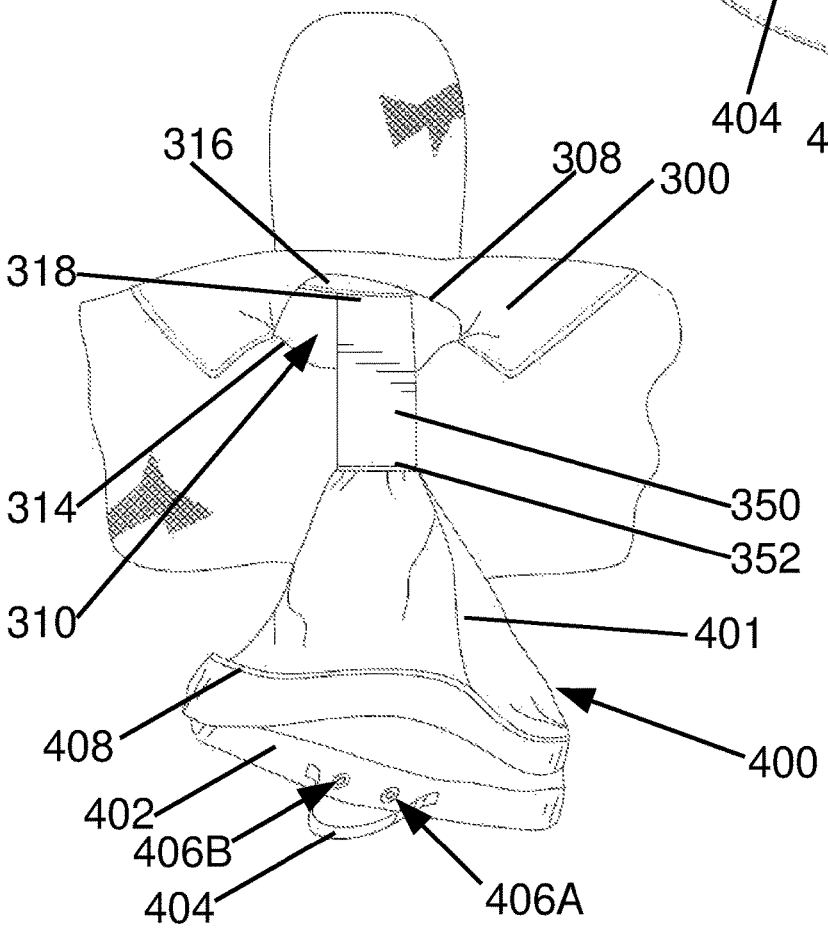

Bag 400 has an outer surface 403 and an inner surface 401, as depicted in FIGS. 9 and 10, when turned inside out, the connection of strap 352 to the bottom of bag 400 may be seen and may be formed by stitching 352, as along a bottom seam of the bag 400.

Strap 350 may be formed as an elongated extends from a first end connected to the lower pouch 400 to an upper end which is secured to the garment 10 underneath the yoke member 308 through yoke opening 312. As best depicted in FIG. 10, the strap 350 may be secured to a securement tab 316 disposed in the yoke recess 320, as by a seam formed by stitches 318. Inside of yoke recess 320, a pocket or pouch may be formed at an upper edge 314 of the rear surface 114.

Bag 400 and strap 350 may both be formed from flexible textile materials, which may be same material as the first surface 102 of the body 100. When the garment 10 is placed in the first or second conformation for use as a poncho, jacket, blanket or protective cover, the bag 400 may be collapsed and placed in the yoke recess 320 for storage, where they may be covered by the yoke member 308. Where present, the bag 400 may reside in the pocket or pouch defined by the upper edge of the rear surface. A hook and loop fastener strip may be used to secure the yoke in place.

Figure 11:
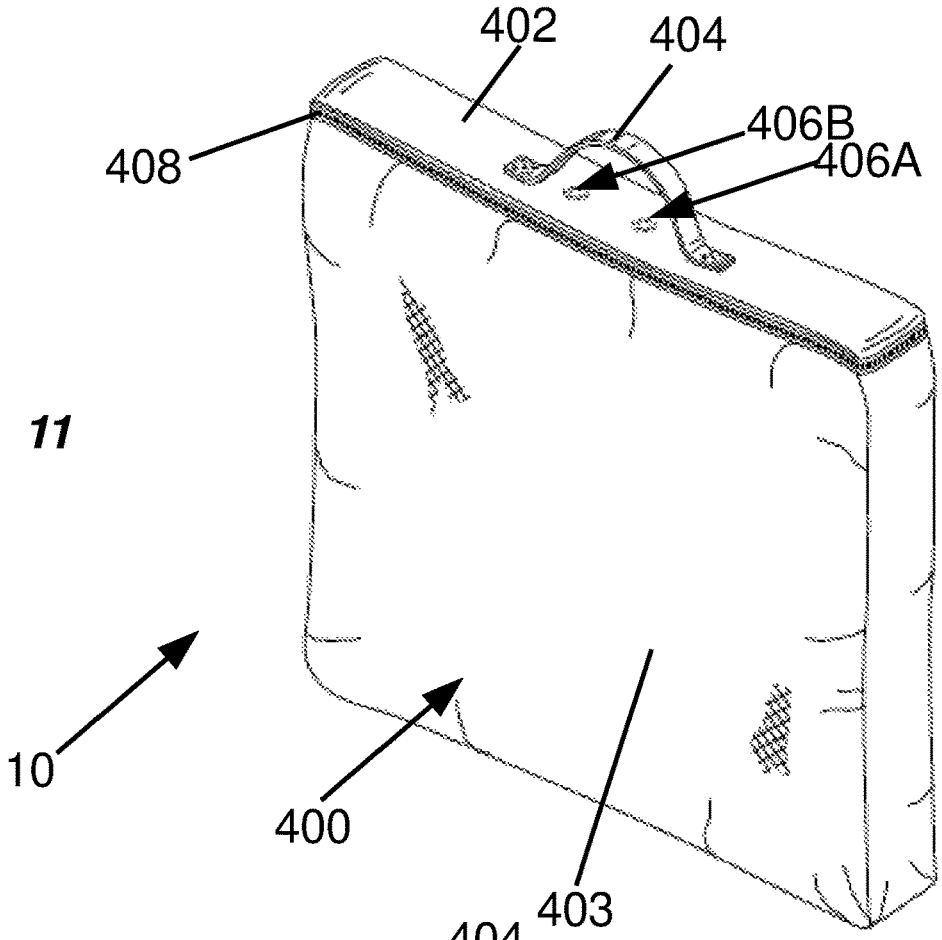
FIGS. 11 and 12 are front perspective and front views of the embodiment of FIGS. 1-10 in the third conformation for use as a cushion or for transport and storage.
Figure 12:
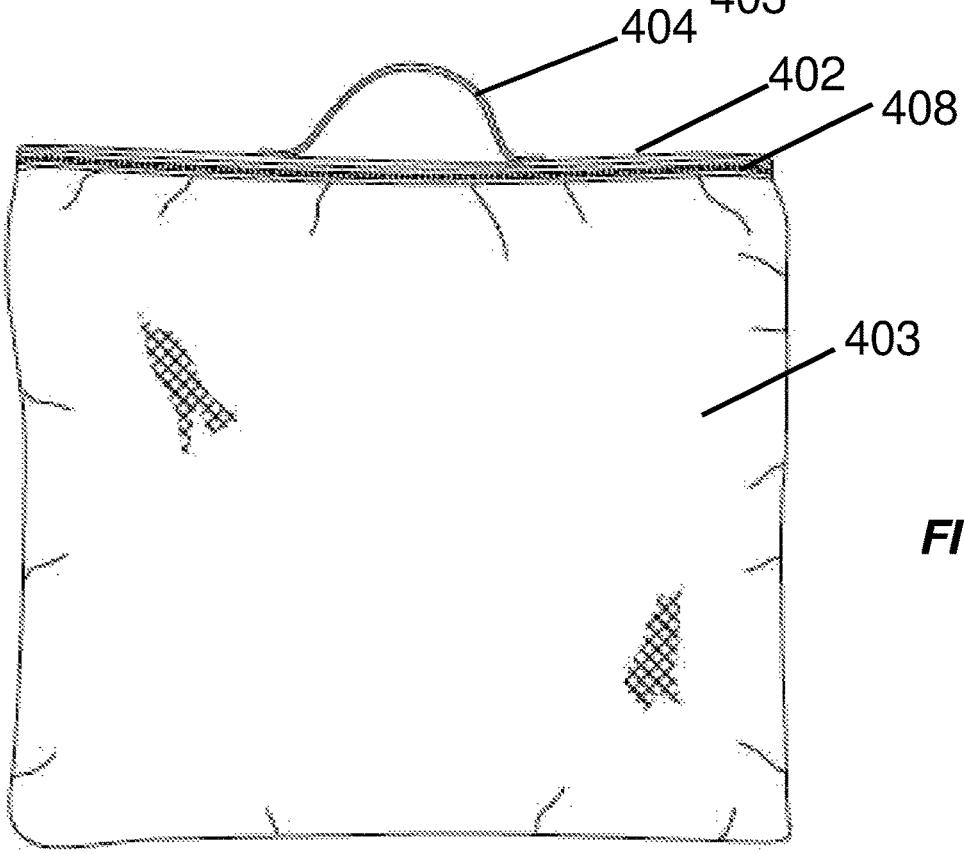

For storage, the bag 400 may be removed from the yoke recess 320 and the strap 350 extended to its length. The body 100 may be folded to correspond to a width of the bag 400 and placed therein. The top flap 402 may be positioned to close the opening and the zipper 408 actuated to close the bag 400 with the garment 10 in a stowed position, as depicted in FIGS. 11 and 12. It will be appreciated that exact details required for folding body 100 may vary based on the relative sizes of the bag 400 and body 100. In the stowed position, the garment 10 may be used as a cushion or pillow. For example, by placement of a first side surface 412 on a bench for use as a seating cushion. When a weight is placed on the garment 10, as by a user sitting thereon, the presence of ports, such as grommets 406A and 406B allows any trapped air inside bag 400 to exit therefrom as it is compressed, preventing the zipper 408 from being damaged during the compression.

It will be appreciated that a garment in accordance with the present invention may be useful for outdoor enthusiasts and other users. For example, the stowed conformation in bag 400 allows it to be easily transported and used as seating cushion and then transformed to the first confirmation for use as a jacket or the second conformation for use as a blanket due or protective cover as inclement weather or other conditions may occur. This may be useful at outdoor events, such as attending games, or for travel. The hood may include a face guard portion and the use of multilayered construction can provide for both an insulated garment and a ground cloth that is both waterproof and soft for contacting a user. It will be appreciated that the placement of the central opening may provide for securement when used as a protective cover in an automobile. The use of a separate, yet attached, pouch can prevent its loss, while keeping a sleek appearance.

The garment 10 may be constructed using any suitable techniques known to those of skill in the art, including seaming materials together by stitching and sewing. Where present, seams in the first surface 102, such as central seam CL forming the shoulder line may be formed as a "taped seam" with a waterproofing material placed underneath the members before stitching to provide a water-resistant joint.

While this disclosure has been described using certain embodiments, the present disclosure can be further modified while keeping within its spirit and scope. This application is therefore intended to cover any variations, uses, or adaptations of the disclosure using its general principles. Further, this application is intended to cover such departures from the present disclosure as come within known or customary practices in the art to which this invention pertains and which fall within the limits of the appended claims.

The invention claimed is:

1. A multi-use convertible garment, comprising:

a textile body formed as a generally planar member having a first side and a second side, and a central opening disposed near a midpoint of the body;

a yoke assembly disposed on the first side of the body, the yoke assembly comprising a textile yoke member attached to the body and defining a yoke recess formed as a pocket, the yoke member attached to the textile body adjacent to the central opening and extending across at least a portion of a width of the body to opposite upper corners on opposite sides of the central opening with a top edge of the yoke member defining a portion of a center line across the body aligned with the top edge of the yoke member, such that the body is capable of being arranged in a first conformation by folding the body along the center line with the second side facing inwards to define a poncho with the central opening at an upper end of the body, a front surface and an opposite rear surface, with the yoke disposed on the opposite rear surface, the yoke member further having at least two sides extending away from the opposite upper corners along a length of the body to opposite lower corners with a yoke member lower edge extending therebetween, the top edge and the at least two side edges secured to the body, and a yoke opening defined between a first portion of the yoke member lower edge and the body;

a strap formed as a flexible member extending from a first end to a second end, the first end of the strap attached to the body in the yoke recess; and a storage pouch attached to the second end of the strap, such that when collapsed the entire storage pouch and the strap are capable of being placed in the yoke recess for storage through the yoke opening.

2. The multi-use convertible garment of claim 1, wherein the textile body comprises at least two layers, with a first layer at the first side and a second layer at the second side, wherein the first layer is a water resistant material.

3. The multi-use convertible garment of claim 2, wherein the second layer is an insulative material.

4. The multi-use convertible garment of claim 1, wherein the textile body is sized to allow the textile body to be folded and stowed in the storage pouch.

5. The multi-use convertible garment of claim 1, wherein the top edge of the yoke member is attached to a seam disposed along the center line to define an upper line of the body when in the first conformation such that the center line resides along the shoulders of a user wearing the defined poncho.

6. The multi-use convertible garment of claim 1, further comprising a series of fasteners disposed along opposite edges of the body for securing the garment in the first conformation.

7. The multi-use convertible garment of claim 1, further comprising a hood assembly attached to the body on the first side and disposed at the central opening.

8. The multi-use convertible garment of claim 7, wherein the hood assembly comprises a face mask assembly.

9. The multi-use convertible garment of claim 1, wherein the first portion of the yoke member lower edge comprises a majority of the length of the yoke member lower edge.

10. The multi-use convertible garment of claim 1, further comprising a pocket assembly disposed on the first side of the body at a position on a front surface the poncho defined by the body when arranged in the first conformation.

11. The multi-use convertible garment of claim 1, further comprising at least a first port disposed in the storage pouch.

12. The multi-use convertible garment of claim 1, further comprising a pocket assembly disposed on the first side of the body at a position on the front surface when arranged in the first conformation.

13. A multi-use convertible garment, comprising:

a multilayered textile body formed as a generally planar member having a first side and a second side, and a central opening disposed near a midpoint of the body;

a hood assembly attached to the body on the first side and disposed at the central opening;

a yoke assembly disposed on the first side of the body, the yoke assembly comprising a textile yoke member attached to the body adjacent to the hood assembly and extending across at least a portion of a width of the body along a length of the hood assembly and extending past either side of the hood assembly to opposite upper corners on opposite sides of the hood assembly with a top edge of the yoke member defining a portion of a center line across the body, such that the body is capable of being arranged in a first conformation by folding the body along the center line with the second side facing inwards to define a poncho with the central opening at an upper end of the body, a front surface and an opposite rear surface, with the yoke disposed on the opposite rear surface, having at least two sides extending away from the opposite upper corners along a length of the body to opposite lower corners with a yoke member lower edge extending therebetween, the top edge and the at least two side edges secured to the body, and a yoke opening defined between the yoke member lower edge and the body and allowing access therethrough to a yoke recess;

a strap formed as flexible member extending from a first end to a second end, the first end of the strap attached in the yoke recess; and a flexible storage pouch attached to the second end of the strap, such that when collapsed the flexible storage pouch and the strap are capable of being placed in the yoke recess through the yoke opening.

14. The multi-use convertible garment of claim 13, wherein the storage pouch further comprises a pouch body with an open top and a pouch flap for closing the open top, and the textile body is sized to allow the garment to be folded and stowed in the storage pouch in a cushion conformation.

15. The multi-use convertible garment of claim 14, further comprising a zipper for securing the pouch flap to the pouch body and at least a first port disposed in the pouch flap to allow air to vent therethrough.

16. The multi-use convertible garment of claim 13, wherein the hood assembly comprises a face mask assembly.

17. The multi-use convertible garment of claim 13, wherein the face mask assembly comprises extensions of side members of the hood assembly that are capable of being secured together.

18. The multi-use convertible garment of claim 13, wherein the at least two sides of the yoke member extend away from the center line.

* * * * *